US006598244B1

(12) United States Patent
Yeh

(10) Patent No.: US 6,598,244 B1
(45) Date of Patent: Jul. 29, 2003

(54) OZONE WATER FOOT MASSAGER

(75) Inventor: Kuo Chung Yeh, Chong Ho (TW)

(73) Assignee: Fu Fong Enterprises Co., Ltd., Taipei (TW)

( * ) Notice: Subject to any disclaimer, the term of this patent is extended or adjusted under 35 U.S.C. 154(b) by 0 days.

(21) Appl. No.: 10/165,493

(22) Filed: Jun. 5, 2002

(51) Int. Cl.[7] ..... A61H 35/00
(52) U.S. Cl. ..... 4/622; 601/156
(58) Field of Search ..... 4/541.1, 541.4, 4/541.5, 622; 601/155, 156, 158

(56) References Cited

U.S. PATENT DOCUMENTS 3,380,080 A * 4/1968 Farrell ..... 4/622
3,741,201 A * 6/1973 Oudkerk ..... 601/156
5,032,292 A * 7/1991 Conrad ..... 4/541.1 X
6,309,366 B1 * 10/2001 Maxwell ..... 601/156 X
6,438,768 B1 * 8/2002 Yen ..... 4/622

* cited by examiner

*Primary Examiner*—Robert M. Fetsuga

(57) ABSTRACT

An ozone water foot massager includes a container disposed on top of a water compartment and having a recess for receiving feet of users. A tubular member is received in the water compartment and coupled to a nozzle, an ozone generator is coupled to the tubular member for supplying an ozone to a neck of the tubular member. The fluid may flow fastener through the neck of the tubular member, for drawing and mixing the ozone and the fluid with each other into an ozonized water, and for supplying the well mixed ozonized water to clean the feet of the users.

5 Claims, 5 Drawing Sheets

OZONE WATER FOOT MASSAGER

BACKGROUND OF THE INVENTION

1. Field of the Invention

The present invention relates to a foot massager, and more particularly to an ozone water foot massager for supplying a mixing ozone and water fluid to clean the feet of the users.

2. Description of the Prior Art

Typical foot massagers comprise a container for receiving water therein and for allowing the feet of the users to immerse into the water received in the container. The containers may comprise one or more massaging members provided therein for massaging the feet of the users. Some of the foot massagers may further provide an ozone generator for generating and for supplying the ozone into the container. However, the ozone may not be suitably mixed with the water.

The present invention has arisen to mitigate and/or obviate the afore-described disadvantages of the conventional foot massagers.

SUMMARY OF THE INVENTION

The primary objective of the present invention is to provide an ozone water foot massager for supplying a suitably mixing ozone and water fluid to clean the feet of the users.

In accordance with one aspect of the invention, there is provided an ozone water foot massager comprising a water compartment including a chamber formed therein for receiving a fluid therein, a container disposed on top of the water compartment, and including a recess formed therein for receiving feet of users, a tubular member received in the chamber of the water compartment for receiving the fluid, a nozzle coupled to the tubular member for receiving the fluid, and disposed in the recess of the container, an ozone generator coupled to the tubular member for generating and supplying an ozone to the tubular member, and means for pumping the fluid through the tubular member, to mix the ozone and the fluid with each other into an ozonized water, and to supply the ozonized water into the recess of the container to clean the feet of the users. The ozone and the fluid may thus be suitably and well mixed with each other into the ozonized water within the neck of the tubular member, and may then be supplied into the recess of the container to clean or to treat or to cure the feet of the users.

The tubular member includes a neck provided therein and having a reduced inner diameter for allowing the fluid to flow faster through the neck, and a port extended from the neck and coupled to the ozone generator. The ozone supplied to the port may be drawn into the tubular member by the fluid that flows faster through the neck of the tubular member, and may thus be suitably and well mixed with the fluid pumped through the tubular member.

The pumping means includes a water pressure pump coupled to the tubular member, for pumping the fluid through the tubular member.

The tubular member includes a first end, the container includes a mouth provided therein and communicating with the recess thereof, and a hose coupled between the first end of the tubular member and the mouth of the container, the water pressure pump is coupled between the mouth of the container and the hose.

A check valve is preferably provided and coupled between the tubular member and the ozone generator, for preventing the fluid and the ozone from flowing backward to the ozone generator.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
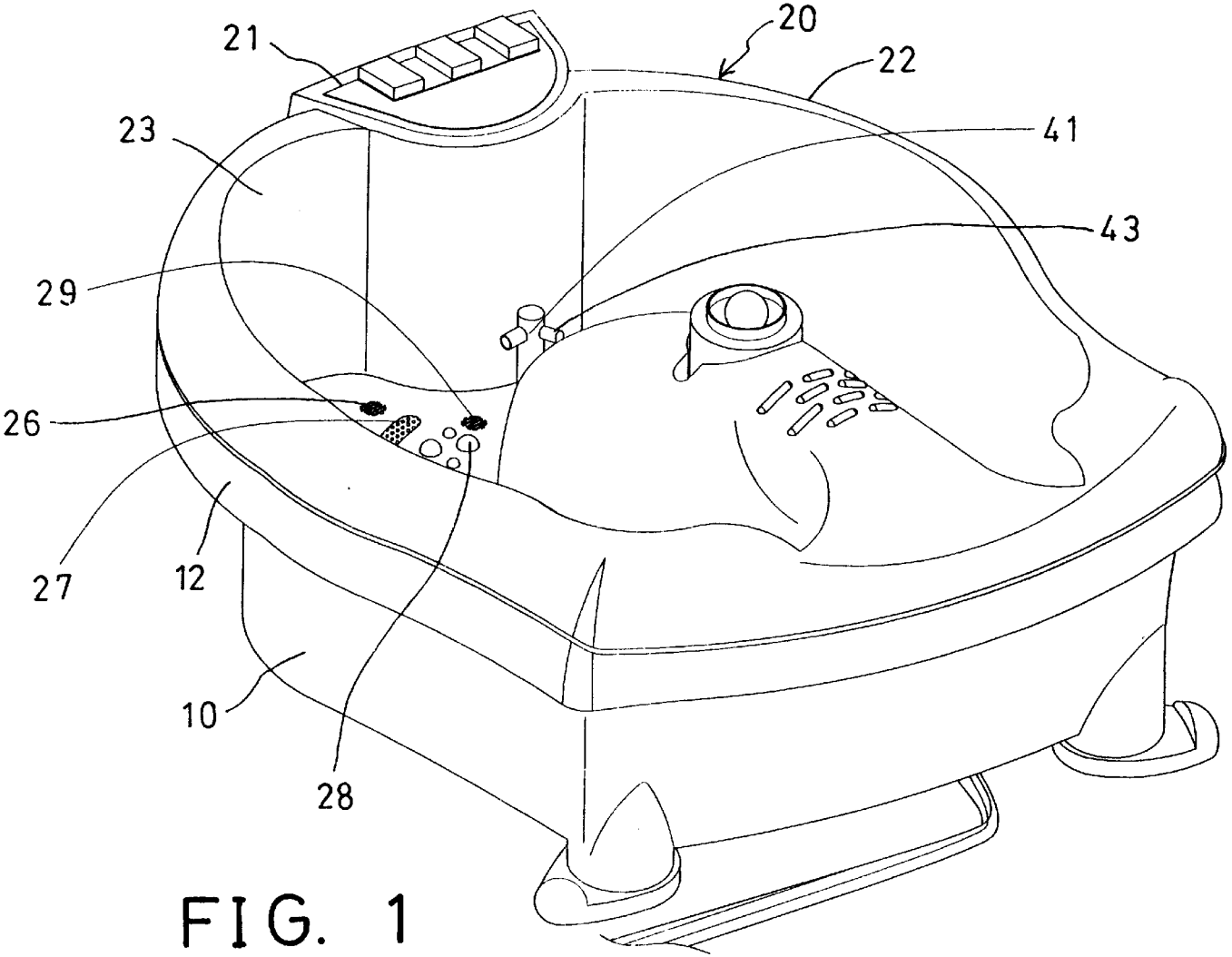
FIG. 1 is a perspective view of an ozone water foot massager in accordance with the present invention.
Figure 3:
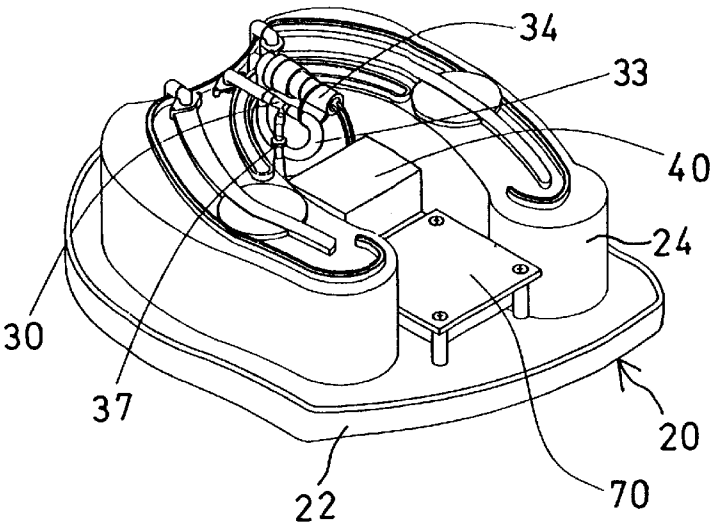
FIG. 3 is a bottom perspective view showing a container of the ozone water foot massager.
Figure 2:
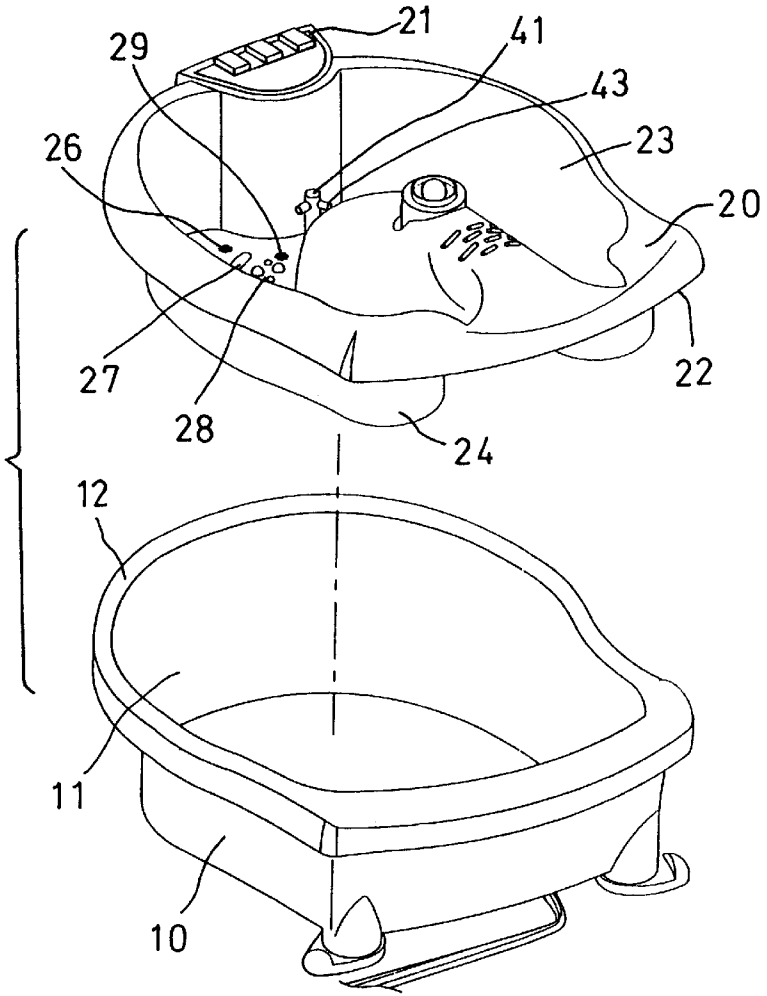
FIG. 2 is a partial exploded view of the ozone water foot massager.

Referring to the drawings, and initially to FIGS. 1–3, an ozone water foot massager in accordance with the present invention comprises a water compartment 10 including a chamber 11 formed therein for receiving water or the other fluid therein, and including a peripheral flange 12 formed and provided on the upper peripheral portion thereof. A container 20 includes a control panel 21 provided on the upper and front portion thereof, and includes a peripheral seat 22 provided thereon for engaging with the peripheral flange 12 of the water compartment 10, and for being supported on the water compartment 10.

Figure 6:
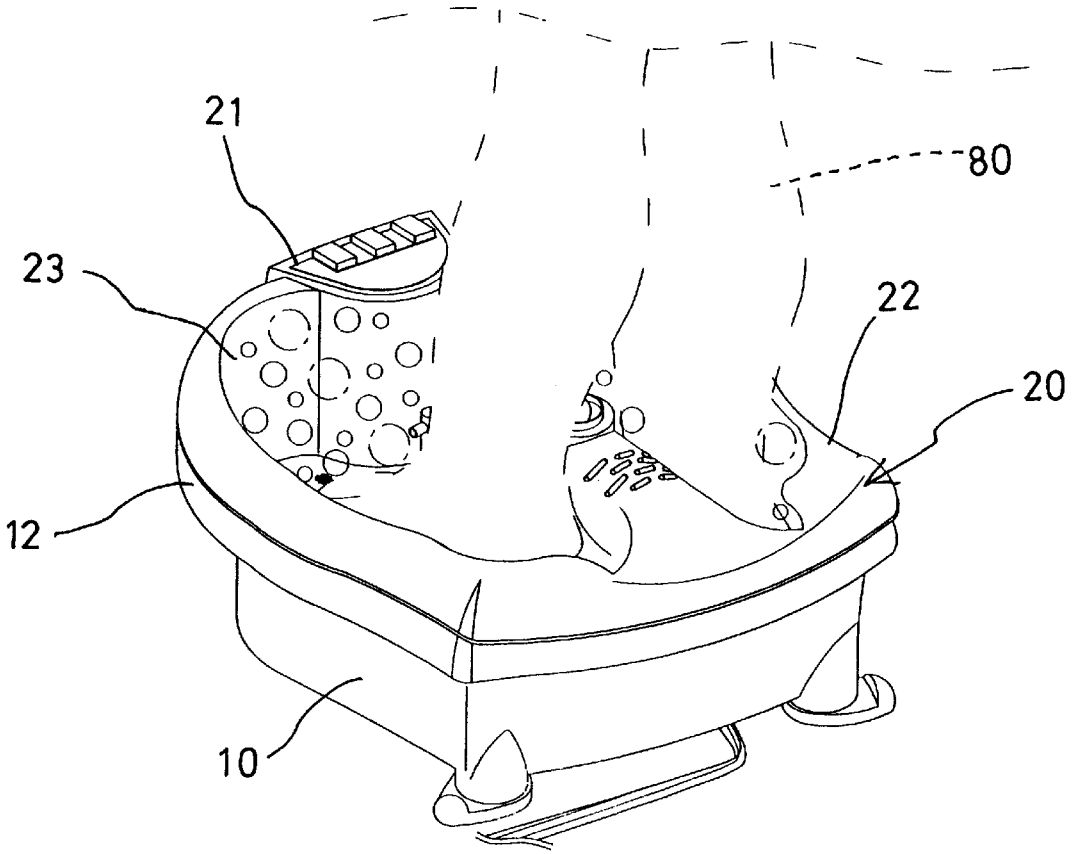
FIG. 6 is a perspective view illustrating the operation of the ozone water foot massager.

The container 20 includes one or more recesses 23 formed therein, such as a U-shaped recess 23 formed therein for receiving the feet 80 of the users (FIG. 6), and formed or defined by a corresponding U-shaped casing 24 which is extended downward from the container 20, for engaging into the chamber 11 of the water compartment 10. The container 20 includes one or more orifices 26 formed in the bottom thereof, or formed in the bottom of the casing 24, for allowing the water contained in the water compartment 10 to flow or to circulate into the recess 23 of the container 20.

The container 20 may further includes one or more apertures 27 formed therein for allowing air bubbles to flow from the water compartment 10 into the recess 23 of the container 20. The container 20 may further includes a number of projections or bulges 28 extended upward from the bottom thereof, or extended upward from the bottom of the casing 24 thereof, for massaging the feet of the users. The container 20 further includes a mouth 29 formed in the bottom thereof, or formed in the bottom of the casing 24 thereof, for communicating the recess 23 of the container 20 with the chamber 11 of the water compartment 10.

Figure 4:
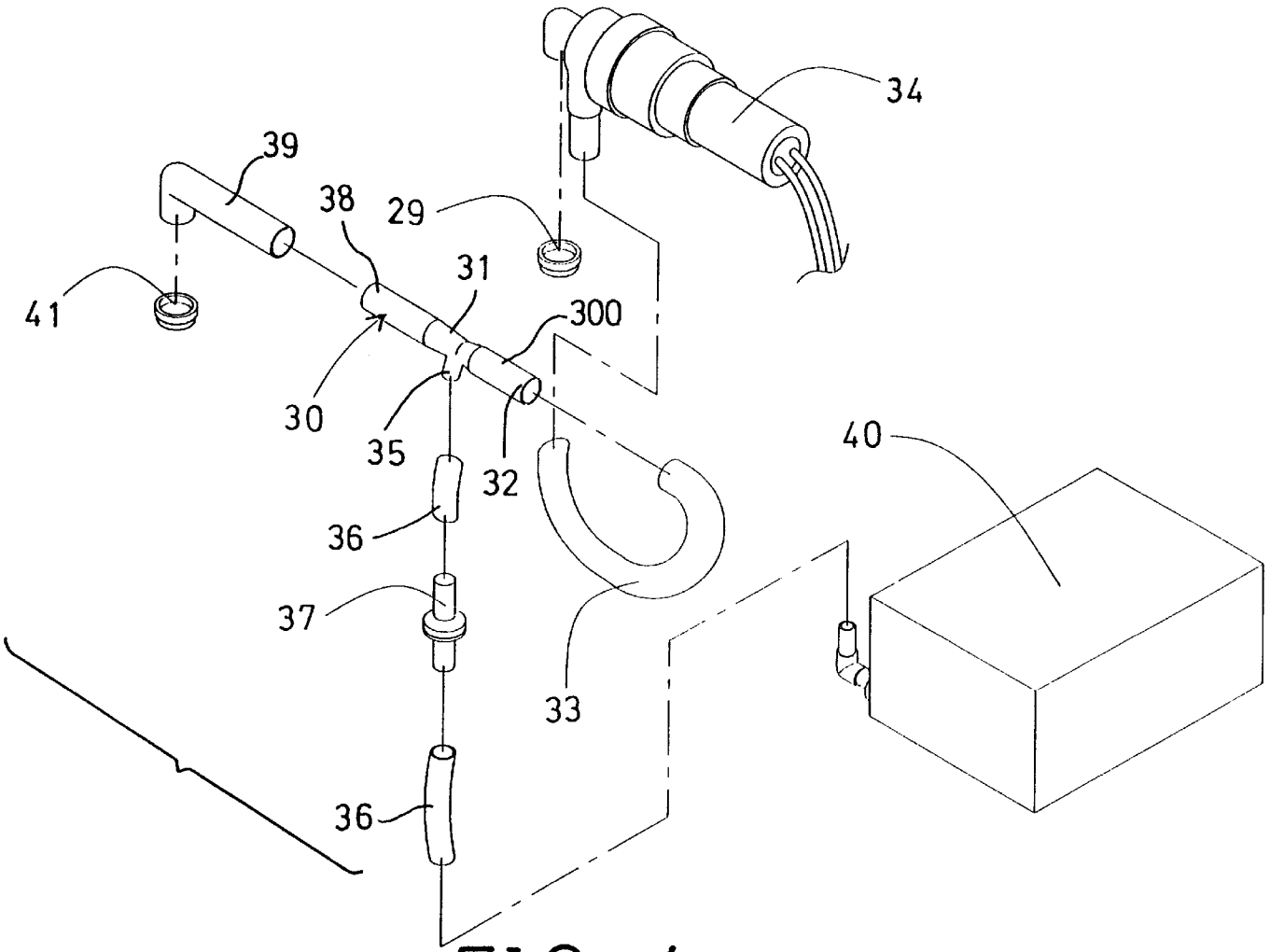
FIG. 4 is a partial exploded view of the ozone water foot massager.
Figure 5:
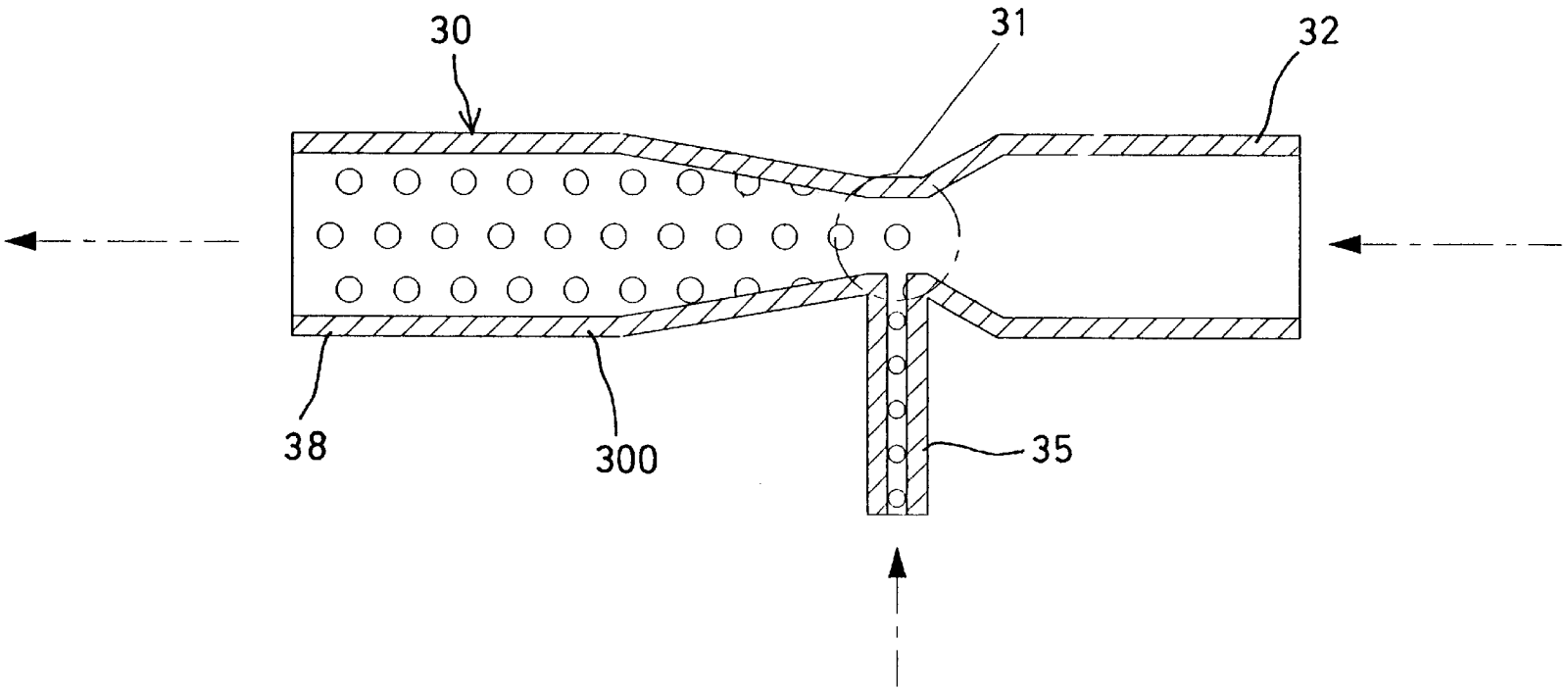
FIG. 5 is a cross sectional view illustrating an ozone/water mixing device of the ozone water foot massager.

As shown in FIGS. 3–5, an ozone/water mixing device 30 includes a tubular member 300 received in the chamber 11 of the water compartment 10 and having a neck 31 formed and provided in the middle portion thereof, and having one end 32 coupled to the mouth 29 of the container 20 with a hose 33 or the like. The neck 31 includes a reduced inner diameter than that of the tubular member 300, particularly less than the one end 32 of the tubular member 300, for forming a venturi tube. The water or the fluid from the one end 32 of the tubular member 30 may flow in a flowing speed less than that flowing through the neck 31; or the water or the fluid may flow faster through the neck 31 of the tubular member 300.

A water pressure pump 34 is coupled between the mouth 29 of the container 20 and the hose 33 for pumping the fluid or the water contained in the recess 23 of the container 20 and/or in the chamber 11 of the water compartment 10 through the tubular member 300 of the ozone/water mixing device 30. The ozone/water mixing device 30 includes a port 35 formed or coupled to or extended from the neck 31 of the tubular member 300, and coupled to an ozone generator 40 via one or more pipes 36 and a check valve 37. The check valve 37 is provided and arranged for allowing the ozone generated by the ozone generator 40 to flow to the tubular member 300 only, and for preventing the ozone or the fluid to flow to the ozone generator 40.

The other end 38 of the tubular member 300 of the ozone/water mixing device 30 may be coupled to a nozzle 41 via one or more hoses 39. The nozzle 41 is provided or extended in the recess 23 of the container 20, and includes one or more outlets 43 extended or provided in the recess 23 of the container 20, and directed toward the feet of the users. In operation, the ozone generated by the ozone generator 40 may be supplied and may flow to the neck 31 of the tubular member 300. The fluid pumped through the neck 31 may include a faster speed, in order to draw the ozone toward the other end 38 of the tubular member 300, for allowing the ozone to be forced and separated into small bubbles, and for allowing the ozone and the fluid pumped through the tubular member 300 to be suitably mixed together or to be mixed with each other.

The ozone and the fluid pumped through the tubular member 300, by the water pressure pump 34, may thus be suitably mixed together and mixed with each other into an ozonized water, and the well mixed ozonized water may then be supplied into the recess 23 of the container 20 via the nozzle 41. The well mixed ozonized water may thus be forced or flushed or applied onto the feet of the users that are immersed in the recess 23 of the casing 24 or of the container 20. The well mixed ozonized water may then be supplied and directed toward the feet of the users by the outlets 43 of the nozzle 41.

It is to be noted that the ozone includes three atoms of oxygen, which may be quickly recovered back to the stable oxygen status having two atoms of oxygen, when the ozone flowing into the environment. The air bubbles flowing out through the apertures 27 of the container 20 may further facilitate the recovering of the ozone back to the stable oxygen status, which may generate or provide a strong oxidization for germicidal purposes, and/or for bleaching purposes, and/or for deodorization purposes, and/or for treating or curing the athlete's foot of the users.

Accordingly, the ozone water foot massager in accordance with the present invention may be used for supplying a suitably mixing ozone and water fluid to clean the feet of the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An ozone water foot massager comprising:

a water compartment including a chamber formed therein for receiving a fluid therein, a container disposed on top of said water compartment, and including a recess formed therein for receiving feet of users, a tubular member received in said chamber of said water compartment for receiving the fluid, a nozzle coupled to said tubular member for receiving the fluid, and disposed in said recess of said container, an ozone generator coupled to said tubular member for generating and supplying an ozone to said tubular member, and means for pumping the fluid through said tubular member, to mix said ozone and the fluid with each other into an ozonized water, and to supply the ozonized water into said recess of said container to clean the feet of the users.

2. The ozone water foot massager according to claim 1, wherein said tubular member includes a neck provided therein and having a reduced inner diameter for allowing the fluid to flow faster through said neck, and a port extended from said neck and coupled to said ozone generator.

3. The ozone water foot massager according to claim 1, wherein said pumping means includes a water pressure pump coupled to said tubular member, for pumping the fluid through said tubular member.

4. The ozone water foot massager according to claim 3, wherein said tubular member includes a first end, said container includes a mouth provided therein and communicating with said recess thereof, and a hose coupled between said first end of said tubular member and said mouth of said container, said water pressure pump is coupled between said mouth of said container and said hose.

5. The ozone water foot massager according to claim 1 further comprising a check valve coupled between said tubular member and said ozone generator, for preventing the fluid and the ozone from flowing backward to said ozone generator.

* * * * *